US006280664B1

(12) United States Patent
Kotyuk

(10) Patent No.: US 6,280,664 B1
(45) Date of Patent: Aug. 28, 2001

(54) METHOD FOR INSTALLATION OF REFRACTORY MATERIAL INTO A METALLURGICAL VESSEL

(75) Inventor: Mark David Kotyuk, Maumee, OH (US)

(73) Assignee: Specialty Minerals ( Michigan) Inc., Bingham Farms, MI (US)

( * ) Notice: Subject to any disclaimer, the term of this patent is extended or adjusted under 35 U.S.C. 154(b) by 0 days.

(21) Appl. No.: 09/402,997

(22) PCT Filed: Sep. 18, 1998

(86) PCT No.: PCT/US98/18502

§ 371 Date: Jan. 27, 2000

§ 102(e) Date: Jan. 27, 2000

(87) PCT Pub. No.: WO99/18244

PCT Pub. Date: Apr. 15, 1999

Related U.S. Application Data

(60) Provisional application No. 60/072,255, filed on Jan. 23, 1998, and provisional application No. 60/060,659, filed on Oct. 2, 1997.

(51) Int. Cl.[7] ..... F27D 1/16

(52) U.S. Cl. ..... 264/30; 264/69

(58) Field of Search ..... 264/30, 69; 425/200, 425/404; 266/280

(56) References Cited

U.S. PATENT DOCUMENTS

| | | | | |
|---|---|---|---|---|
| 3,832,097 | * | 8/1974 | Schlect | 417/516 |
| 4,421,697 | * | 12/1983 | Taguchi et al. | 264/30 |
| 4,442,050 | * | 4/1984 | Takuo | 264/30 |
| 4,469,309 | * | 9/1984 | Takashima et al. | 266/44 |
| 4,534,730 | | 8/1985 | Kraus | 432/3 |
| 4,589,633 | | 5/1986 | Gilson et al. | 266/44 |
| 4,602,771 | | 7/1986 | Milliron et al. | 266/281 |
| 5,505,893 | * | 4/1996 | Connors, Jr. | 264/30 |
| 5,632,937 | * | 5/1997 | Soofi et al. | 264/30 |
| 5,795,508 | * | 8/1998 | Soofi et al. | 264/30 |

* cited by examiner

*Primary Examiner*—Christopher A. Fiorilla
(74) *Attorney, Agent, or Firm*—McDermott, Will & Emery

(57) ABSTRACT

A method for forming a lining on the internal faces of a vessel involves installing a granular composition into a gap formed between the internal faces of the vessel and a mandrel. The granular composition is dropped into the gap in the form of a single mass.

50 Claims, 16 Drawing Sheets

METHOD FOR INSTALLATION OF REFRACTORY MATERIAL INTO A METALLURGICAL VESSEL

This application is a 371 of PCT/US98/18502 filed Sep. 18, 1998 which claims benefit to U.S. Provisional Patent Application No. 60/060,659 filed Oct. 2, 1997 and U.S. Provisional Patent Application No. 60/072,255 filed Jan. 23, 1998.

FIELD OF THE INVENTION

The present invention generally relates to a method and apparatus for forming a lining on the internal faces of a metallurgical vessel, such as a tundish or a casting ladle in order to protect the vessel wall or its permanent refractory lining.

BACKGROUND OF THE INVENTION

Refractory products are often utilized as protective layers to protect the vessels that hold and transfer molten metal in metal casting processes such as steel making. For example, refractory products may be utilized as protective layers to protect furnaces ladles, and tundishes. The purpose of the protective layer is to protect the brick, safety lining, and steel shell of the vessel from steel and slag penetration. By inhibiting this penetration, the protective layer prolongs the life of the vessel.

Conventional methods for forming protective layers include installing a granular refractory composition on the interior faces of a metallurgical vessel and heating the granular refractory composition to solidify and form a protective lining.

The problems associated with installing refractory material in metallurgical vessels are well-known. Various methods are currently used with various drawbacks. For instance, according to one method, a protective layer is applied on the internal faces of a metallurgical vessel by spraying a water-based slurry consisting of a mixture of refractory materials, fibers and a binder. Although this method proves satisfactory, it suffers from the disadvantage of covering the internal faces of the metallurgical vessel with a lining containing a considerable quantity of water, which has to be eliminated by a long and costly drying operation. A second known method includes installing a dry refractory lining composition into a space located between the internal faces of the metallurgical vessel and a mandrel placed within the vessel. The mandrel can be equipped with preheating means and valves through which heat can be applied which sets (hardens) the lining composition that has been poured into the space mentioned above.

Past practices for installing the protective layers have the following drawbacks:

1. In the first method, the main drawback is that considerable water is required, thus requiring drying. In addition, this method has the further drawbacks as follows:
   a. the slurry spraying equipment requires considerable maintenance,
   b. the slurry compositions require careful manufacture to meet specifications, and
   c. the installation of the slurry is labor intensive and time consuming.
2. In the second method, although no water is required, considerable drawbacks still exist as follows:
   a. the use of manual labor to hand break 50 to 100 lb. bags of granular refractory material, b. the unsafe method of loading bulk sacks of granular refractory material into a metallurgical vessel,
   c. the unsafe method of loading bulk sacks of granular refractory material into a feed hopper to create a reserve and then dispensing the granular refractory material into the metallurgical vessel (i) by a feed chute or funnel or (ii) by a mechanical feeding apparatus,
   d. the unsafe method of hanging a bulk sack of granular refractory material that has a special discharge spout sewn into it over the metallurgical vessel to empty the granular refractory material,
   e. the unsafe method of hanging bulk containers of granular refractory material with special outlet discharge hoses over the metallurgical vessel to empty the granular refractory material, and
   f. the action of filling the gap can cause segregation of coarse and fine particles resulting in weak areas.

The conventional methods are labor intensive and create unsafe working conditions, especially when working under or near overhead hanging loads. The past practices also create a very irritating dusty work environment.

For example, U.S. Pat. No. 5,302,563 to Rumpeltin et al., and U.S. Pat. No. 5,036,029 to Johnson disclose methods for wet spraying a refractory composition to form a lining in a metallurgical vessel.

In an attempt to overcome the disadvantages of installing a dry composition, U.S. Pat. No. 5,176,873 to Daussan et al. discloses a method that involves the use of a movable wall to form a lining on the internal faces of a metallurgical vessel using a dry granular refractory material. The method involves positioning the movable wall into the metallurgical vessel, introducing the granular refractory material between an internal face of the metallurgical vessel and the movable wall, heating the granular refractory material to sinter the internal face, transversely displacing the movable wall, and repeating the above steps until a lining is complete on the internal faces of the metallurgical vessel. Since the lining of Daussan is prepared one portion at a time, different portions of the lining set at different times. This results in the development of seams in the lining. In particular, the device discussed in Daussan does not permit the development of a continuous lining at the corners of the metallurgical vessel and rather results in seams. This is due to the fact that the device needs to be displaced from each wall once the lining against the wall is made and replaced onto the next wall to begin forming the lining against that wall. During this time, the previous wall cools. Once the subsequent wall is formed, a seam is formed at the corner between the previous and the subsequent wall.

There therefore remains a need for better methods and apparatus that are capable of forming a refractory lining on the internal faces of a metallurgical vessel such as a tundish. The aim of the present invention is to overcome the disadvantages of known methods.

SUMMARY OF THE INVENTION

As an aid to understanding, but without being limited thereby, the present invention is based on the discovery that the addition of a granular refractory composition in a single mass results in improved integrity of the resulting refractory lining in a vessel such as a metallurgical vessel. When the granular refractory composition is added in a single mass into a gap formed between the metallurgical vessel and a mandrel, the turbulence that is created causes a mixing action that tends to reduce any segregation of particle sizes in the granular refractory composition that may have been present. The mixing action can be further enhanced by use of deflectors, which aid the flow and mixing as the granular composition is added into the gap. Furthermore, although air is not required for the inventive method, any air in the gap that is displaced by the granular composition further aids the mixing thereof. The resulting refractory lining has a more homogeneous structure than conventional refractory linings. The improved homogeneous structure in the refractory lining of the present invention results in less "weak zones," within the resulting refractory lining. Thus, the refractory lining prepared according to the present invention has a longer life expectancy than conventional refractory linings prepared by conventional methods even if the same refractory materials are used.

In addition, the inventive method, which reduces segregation of the particle sizes, permits the use of granular compositions having a wider particle size distribution than conventional methods.

Accordingly, it is an object of the present invention to provide a method and apparatus for installing a granular refractory composition into a vessel such as a metallurgical vessel.

It is another object of the present invention to provide a method and apparatus for installing a granular refractory composition into a metallurgical vessel so as to form a continuous lining therein.

It is a further object of the present invention to provide a simple and efficient method and apparatus for installing a granular refractory composition into a metallurgical vessel.

It is yet a further object of the present invention to provide a method and apparatus for installing a granular refractory composition into a metallurgical vessel that require minimum manual intervention.

It is another object of the present invention to eliminate the health risks that are associated with the handling of refractory material during installation into a metallurgical vessel.

In accordance with the above and other objects, the inventive method comprises installing a granular refractory composition into a gap formed between a mandrel and the interior faces of a metallurgical vessel, wherein the installing includes positioning the granular refractory composition over the metallurgical vessel and allowing the granular refractory composition to drop into the gap in a single mass. This process can be carried out one or more times until installation is complete.

The inventive apparatus may include, for example, a hopper that serves as both a transporting and installing device, wherein the hopper is adapted to install a granular refractory composition into a gap formed between a mandrel and the interior faces of a metallurgical vessel, wherein the installation includes dropping the granular refractory composition into the gap in a single mass. Other apparatus that can be used to drop granular refractory composition into a gap formed between a mandrel and a metallurgical vessel in a single mass to install a refractory lining would be within the scope of the present invention.

The inventive method and apparatus may be used with apparatus such as a storage member for storing refractory material reserves; a feeding member for dispensing the stored refractory material into the transporting and installing device; a mandrel member designed and built to give the proper finished working lining contour in a metallurgical vessel; a vibrating member to further reduce the porosity of the lining; and a heating member to heat set the refractory material, to ease the installation of refractory material in a metallurgical vessel. All of these apparatus are well-known to those skilled in the art.

The present invention is also directed to the refractory lining that results from use of the present inventive method and apparatus. The refractory lining may be characterized by its more homogeneous structure, as well as by its ability to withstand wear during steel processing.

Additional objects and attendant advantages of the present invention will be set forth in the description and examples that follow, or may be learned from practicing the method or using the apparatus of the present invention. These and other objects and advantages may be realized and attained by means of the features, instrumentalities and/or combinations particularly described herein. It is also to be understood that the foregoing general description and the following detailed description are only exemplary and explanatory and are not to be viewed as limiting or restricting the invention as claimed.

The invention itself, together with further objects and attendant advantages, will best be understood by reference to the following detailed description, taken in conjunction with the accompanying drawings.

BRIEF DESCRIPTION OF THE DRAWINGS

In the following description, like parts are designated by like reference numbers throughout the figures.

DETAILED DESCRIPTION OF THE INVENTION

Figure 1:
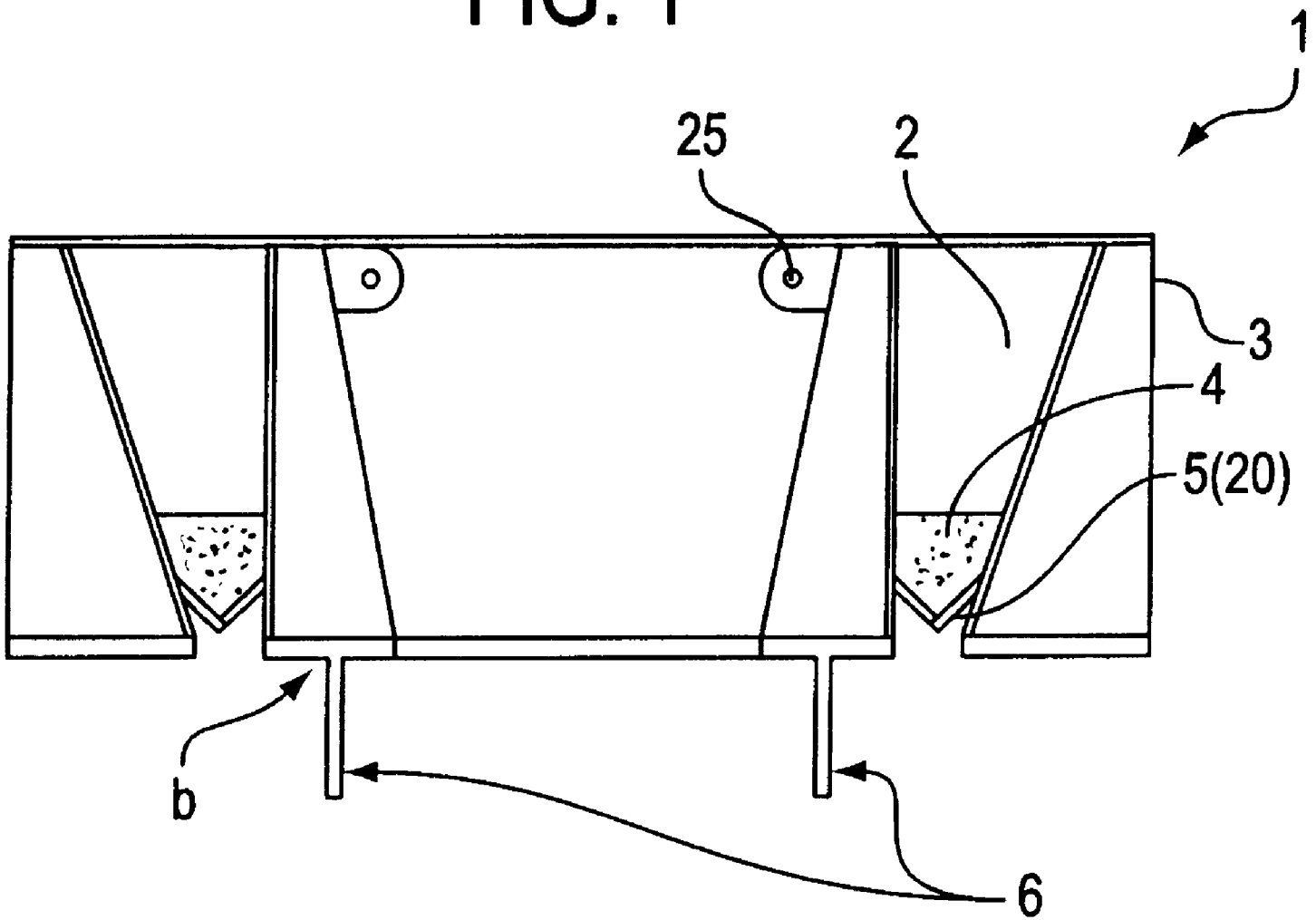
FIG. 1 is a schematic showing a cross sectional view of one example of a transporting and installing device for installing a protective lining in accordance with the method of the present invention.

All patents, patent applications and literatures that may be cited in this description are incorporated herein by reference in their entirety.

As a further aid to understanding the present invention, but without being limited thereby, it is believed that dropping a granular composition into a gap formed between a mandrel and a metallurgical vessel in a single mass creates turbulence that causes a mixing action that tends to homogenize any segregation of particle sizes that may have been present in the granular composition.

It is to be understood that although the present disclosure is directed to the installation of a granular refractory composition into a metallurgical vessel, the inventive method includes the installation of any type of granular composition into any type of vessel. It is well-known in the art that a segregated refractory lining, i.e., one in which larger particles and smaller particles are not distributed evenly throughout, is not as durable as a homogeneous refractory lining. This is due in part because a segregated refractory lining can lead to differential shrinkage which leads to cracking and total lining weakness. This, in turn, leads to metal and slag penetration, which damages the metallurgical vessel.

The invention involves a method that eases the installation of granular refractory compositions, and, in particular, dry vibratable refractory compositions, into a metallurgical vessel working lining. The invention also involves apparatus that permit the carrying out of the inventive method.

The granular refractory composition may contain one or more of the materials disclosed in, for example, U.S. Pat. No. 5,300,144 to Adams, and U.S. Pat. No. 5,366,944 to Rumpeltin et al., the entire contents of which are incorporated herein by reference. As discussed in U.S. Pat. No. 5,300,144, the dry vibratable granular refractory composition is substantially dry and free flowing. Thus, although a liquid component may be present in the dry vibratable granular refractory composition, the concentration of any liquid component must not be so great as to cause the composition to cease being free flowing.

Conventional installation practices involve cumbersome, laborious, and safety compromising techniques. The present invention, in contrast, allows the granular refractory composition to be installed by one operator quickly and safely. This is possible partly due, for example, to the use of a transporting and installing device that can transport the granular refractory composition to the metallurgical vessel and install the granular refractory composition into a gap formed between the interior walls of the metallurgical vessel and the outer surfaces of a mandrel placed within the metallurgical vessel in a single drop. Although this process can be carried out one or more times until installation is complete, it is preferred that an amount of granular refractory composition sufficient to complete installation is installed in one drop. The ability of the transporting and installing device to drop the granular refractory composition into the gap in a single mass permits the rapid formation of a continuous refractory lining in the metallurgical vessel.

The method and apparatus of the present invention thus permit a rapid and safe means for installing a refractory lining into a metallurgical vessel.

The continuous refractory lining of the present invention is advantageous over conventional refractory linings in that it has greater life expectancy, which results in less cost to the user.

The inventive apparatus may be used with the following apparatus to achieve rapid and effective installation of granular refractory composition into a metallurgical vessel:

(1) a storage member for storing granular refractory composition reserves;

(2) a feeding member for dispensing the stored granular refractory composition into the transporting and installing device;

(3) a reusable mandrel member that may be designed and built to give the proper finished working lining contour in a metallurgical vessel and that may be adapted to aid in the positioning of the transporting and installing device over the metallurgical vessel;

(4) a heating member that may be designed and built specifically to fit the mandrel member and to bake the installed granular refractory composition to the proper set; and (5) a mechanical vibrating member.

The method of the invention permits safer, easier, more economical, and more predictable installation of refractory linings in metallurgical vessels.

Turning now to the drawings, FIG. 1 is a schematic showing an example of a transporting and installing device 1 that may be used to achieve the method of the present invention. The transporting and installing device 1 comprises a cavity 2 around at least a portion of its outer perimeter 3 for holding a granular composition 4 such as a granular refractory composition. The granular composition 4 is held within the cavity 2 by one or more valves 5, which when opened, permit the installation of the granular composition 4 into a vessel such as a metallurgical vessel (see FIG. 4).

Although the cavity 2 may hold a calculated amount of granular refractory composition 4 to complete the working lining installation in a single drop, the amount of granular refractory composition 4 need not be precisely measured, since if underfilled, additional drops may be carried out to complete the installation, and if overfilled, the valves 5 will close, thus allowing the use of any overfill to install a second lining.

The transporting and installing device 1 may also have a lifting device 25 fabricated into the design to facilitate transport to the various stations during its cycle.

The transporting and installing device 1 holds the granular composition 4 with a simple valve system or the like that is incorporated on all sides. Any type of valve system may be employed, including actuators, pneumatics and hydraulic systems. Each valve 5 may be a hinged dump gate. The joints of the hinges may be covered with a flexible shield to keep them from contacting the refractory material. This helps keep the hinges from jamming. The valve dump gate may be actuated and latched from outside the granular composition 4 holding structure. The latching mechanism can be constructed in any configuration that may need to be incorporated into a specific situation. Actuation can be manual or by automated means. The valves 5 are closed when being loaded and during transport and opened during installation.

The entire transporting and installing device 1 may be designed to be rigid and self-supporting. Furthermore, for convenience, the transporting and installing device 1 may be specially designed to mate to a mandrel member 7 (see FIGS. 3, 4 and 5) with minimal effort. This can be done, for example, by having the base b (see FIGS. 1, 4 and 5) of the transporting and installing device 1 be the foundation that mates the structure to the mandrel member 7. This may be accomplished by a guidance system that is incorporated into the base b. The base b would thus mate quickly with minimal effort with the top of the mandrel member 7 into mating guide 8 as designed. This simple system aids in the positioning of the transporting and installing device 1 over a working lining gap 10 (see FIG. 4). Other apparatus may be used to ensure proper positioning of the granular composition over the metallurgical vessel.

The transporting and installing device 1 can hold the proper amount of granular composition 4 to install all of the working lining walls of the metallurgical vessel 9 (see FIG. 4) at one time. The installation time is a fraction compared to conventional practices, and requires only one operator. With the transporting and installing device 1 properly positioned, the installation operator only actuates the drop. This is not a laborious or unsafe task, as is the current practice.

The transporting and installing device 1 thus preferably contains guiding members 6 (see FIGS. 1 and 4), for guiding and positioning the transporting and installing device 1 over an adapted mandrel member 7 placed in the metallurgical vessel 9.

Figure 2:
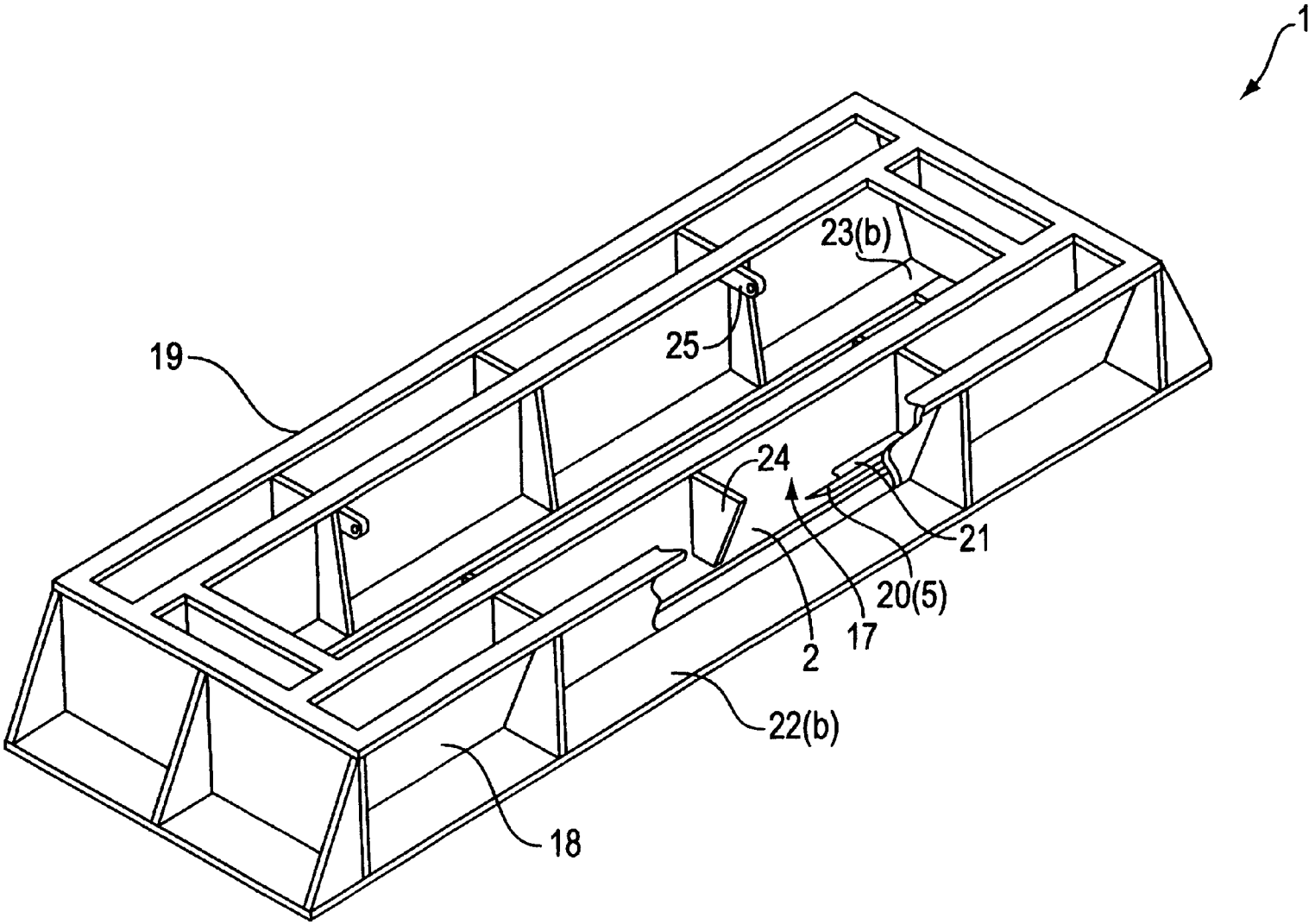
FIG. 2 is a schematic showing a fragmentary plan view of a transporting and installing device.

Turning now to FIG. 2, which shows a fragmentary plan view of the transporting and installing device 1. As can be seen from a review of FIG. 2, the cavity 2 is defined by an inner wall 17 that surrounds the inner perimeter forming the cavity 2; an outer wall 18 that surrounds the outer perimeter forming the cavity 2; an upper flange 19 that provides rigidity and structural strength to the transporting and installing device 1; and one or more dump gates 20 (or valves 5) and one or more deflectors 21 that form the floor of the cavity 2, thus forming a seal when the dump gates 20 (or valves 5) are closed. The one or more dump gates 20 (or valves 5) and the one or more deflectors 21 are supported by the inner wall 17 and the outer wall 18. The number of dump gates 20 (or valves 5) and deflectors 21 depends upon the shape of the transporting and installing device 1. In FIG. 2, there would be four dump gates and four deflectors (not all shown), one dump gate 20 (or valve 5) and one deflector 21 for each side of the rectangular-shaped transporting and installing device 1. The dump gates 20 (or valves 5) and deflectors 21 are closed upon transporting the granular composition 4 (see FIGS. 1 and 4) and opened upon installing the granular composition 4. When the dump gates 20 (or valves 5) are opened, the deflectors 21 help center the granular composition 4 as it falls into the tundish, thus permitting the granular composition 4 to slide down the inner wall 17. More importantly, the deflectors 21 can direct and aid in the flow and the premixing of the granular composition 4 as the granular composition 4 falls into the gap 10 (see FIG. 4). The increased mixing is desirable in that it further aids the formation of a homogenous lining. The transporting and installing device 1 may also contain one or more external mating flanges 22 (or b) and one or more internal mating flanges 23 (or b). The one or more external mating flanges 22 (or b) aid the mating of the transporting and installing device 1 to the metallurgical vessel 9 (see FIG. 4) and the one or more internal mating flanges 23 (or b) aid in the mating of the transporting and installing device 1 to the mandrel member 7 (see FIG. 4). One or more internal webs 24 may also be used to further support the inner wall 17, the outer wall 18, the upper flange 19, the one or more dump gates 20 (or valves 5) mounted on the outer walls 18 and the one or more deflectors 21 mounted on the inner walls 17 that form the cavity 2. The transporting and installing device 1 may also contain a lifting device 25, for example a lifting eye, incorporated therein to aid in the lifting and transport of the transporting and installing device 1.

Figure 3:
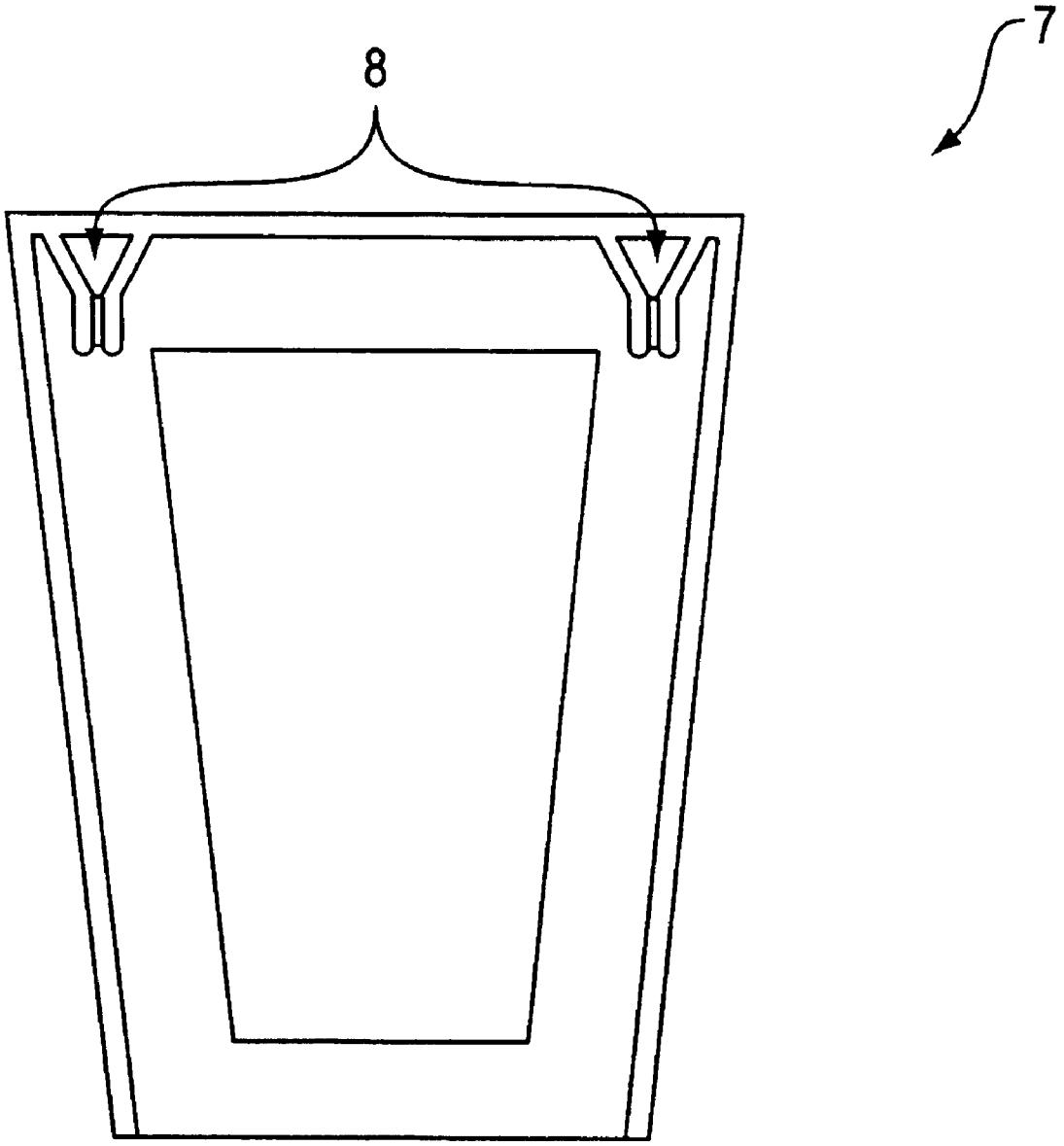
FIG. 3 is a schematic showing a cross sectional view of an adapted mandrel that may be used as an accessory apparatus with the transporting and installing device.

Turning now to FIG. 3, which is a schematic showing a mandrel member 7. The mandrel member 7 may contain complementary guiding members 8 that complement the guiding members 6 in the transporting and installing device 1 as shown in FIG. 1 and FIG. 4 in order to aid in the positioning of the transporting and installing device 1 over the metallurgical vessel 9.

Figure 4:
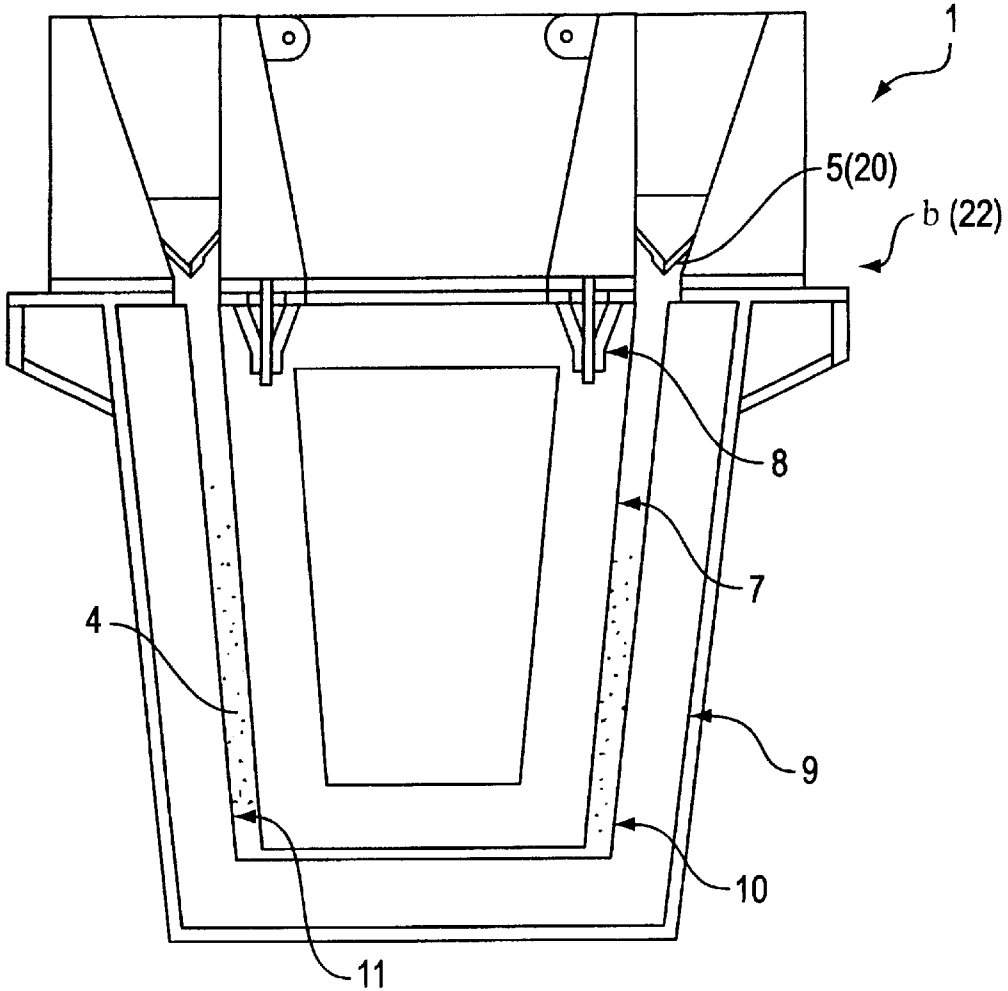
FIG. 4 is a schematic showing a cross sectional view of the positioning of the transporting and installing device over the mandrel and the metallurgical vessel so as to allow an amount of the granular refractory composition sufficient to fill a gap formed between the mandrel and the metallurgical vessel to drop into the gap in a single mass.

Turning now to FIG. 4, which is a schematic showing the positioning of the transporting and installing device 1 over the mandrel member 7. As can be seen in FIG. 4, the complementary guiding members 8 of the mandrel member 7 are adapted to mate with the guiding members 6 of the transporting and installing device 1 so as to allow rapid positioning of the transporting and installing device 1 above the metallurgical vessel 9 with minimal effort. Proper positioning permits rapid installation of the granular composition 4 into a gap 10 formed between the mandrel member 7 and the interior faces 11 of the metallurgical vessel 9. The transporting and installing device 1 and the mandrel member 7 are oriented together with a prepared metallurgical vessel 9 so as to allow the granular composition 4 to be installed in seconds. Conventional methods using conventional apparatus can take 30 minutes or more and generally require more than one operator. When the granular composition 4 is finished dropping, a mechanical vibrating member 15 (see FIG. 5) may be actuated to settle the granular composition 4 to a proper density. Once the granular composition 4 reaches its proper density, a heating device 14 (see FIG. 5 and FIG. 10), similar to what is now used in the industry, may be used to solidify the granular composition 4.

Figure 5:
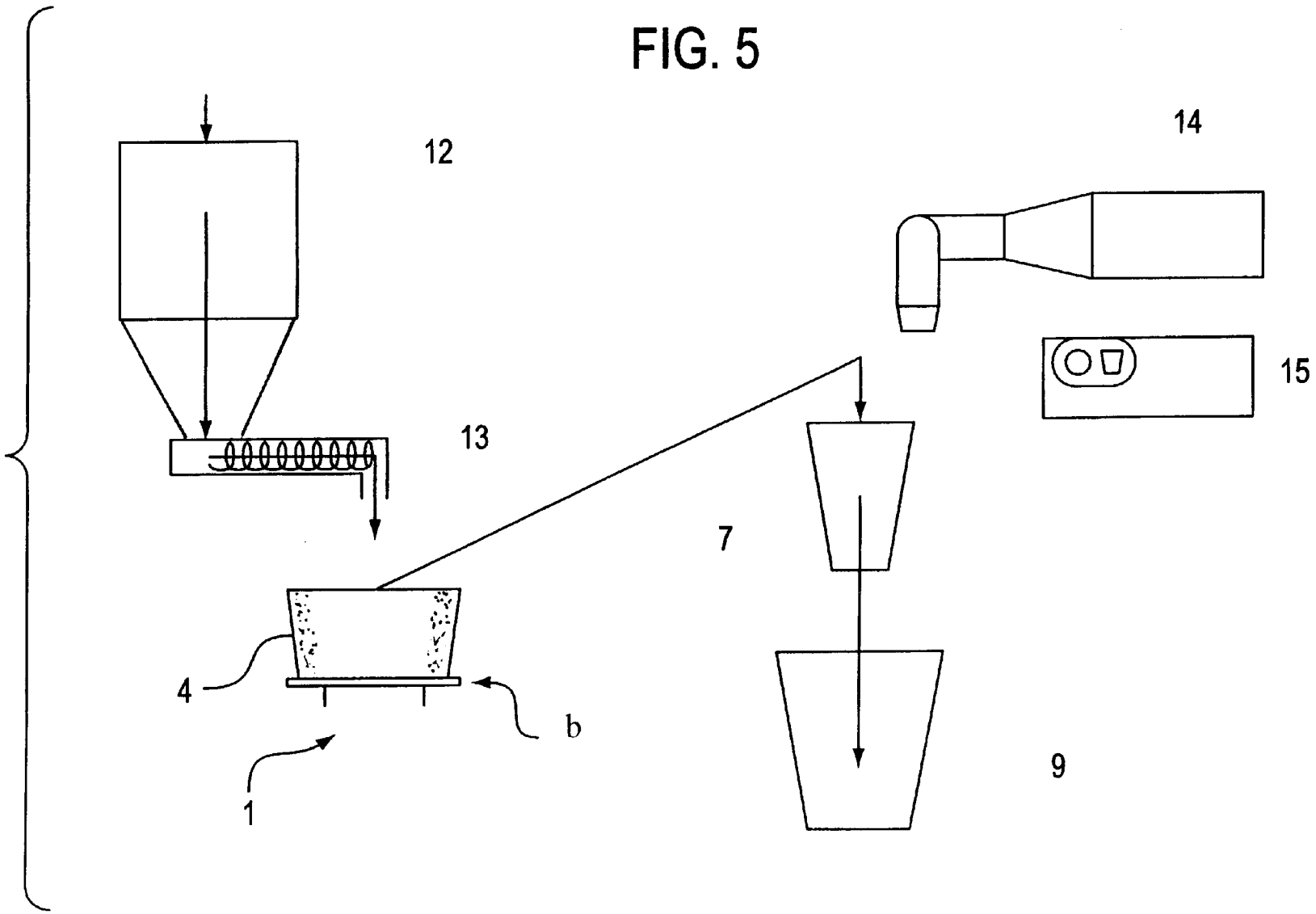
FIG. 5 is a schematic showing accessory apparatus that may be employed with the inventive method and apparatus to ease the installation of the granular refractory composition into a metallurgical vessel.

Turning now to FIG. 5, which is a schematic showing apparatus that may be used with the method and apparatus of the present invention. The apparatus may include: a storage member 12, a feeding member 13, a heating member 14, a vibrating member 15 and a mandrel member 7. The apparatus may be used to complement the inventive method and, for example, the transporting and installing device 1 to further aid in the installation of the granular composition 4 into the metallurgical vessel 9.

As discussed above, the inventive method and apparatus eliminate the need for hard labor and unsafe working conditions and significantly reduce installation time and dust.

Referring to FIG. 5, material that is held in the storage member 12 is fed by the feeding member 13 to the transporting and installing device 1. The transporting and installing device 1 is transported to the mandrel member 7 that has been placed into the prepared metallurgical vessel 9 to be lined. The mandrel member 7 may be self-indexing into the metallurgical vessel 9 (see FIG. 10, 29 and 6). The transporting and installing device 1 then indexes itself into the proper position on top of the mandrel member 7. When the metallurgical vessel 9, the mandrel member 7 and the transporting and installing device 1 have been mated, dump valves 5 (see FIG. 1 and FIG. 4) in the transporting and installing device 1 are opened. With the dump valves 5 opened, the granular composition 4 flows in a fluid-like manner into the engineered working lining gap 10 (see FIG.

Figure 9:
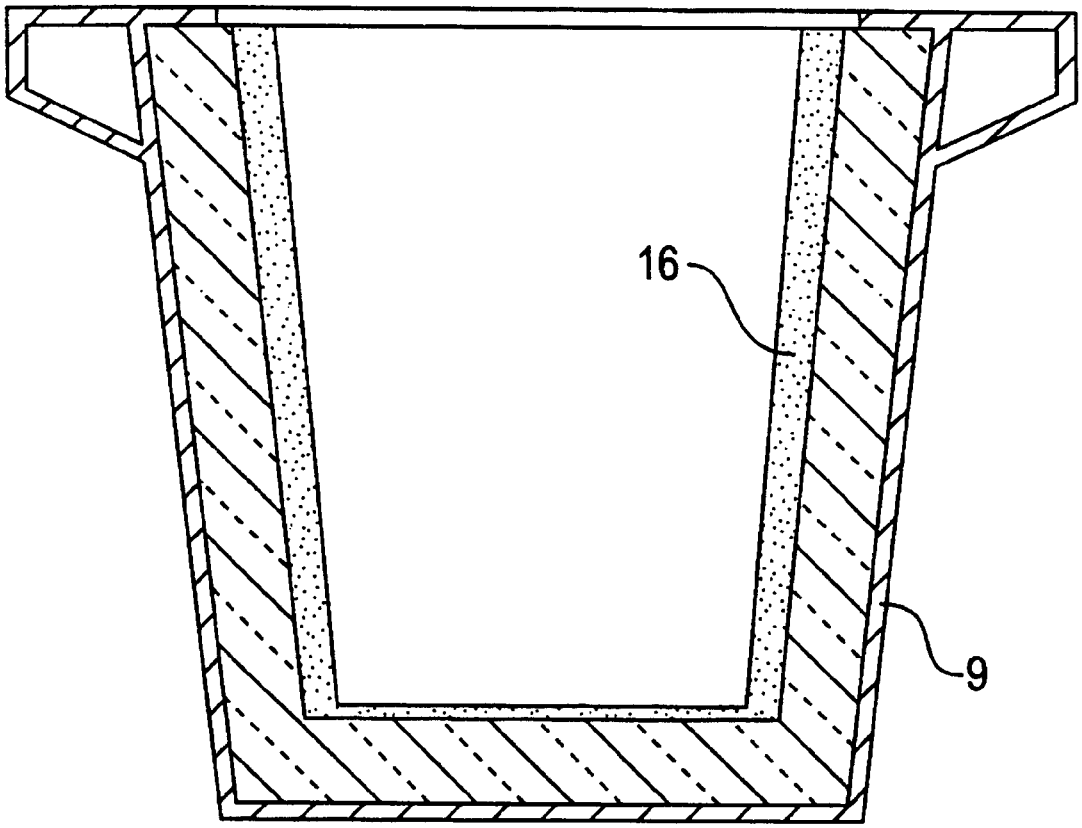
FIG. 9 is a schematic showing a cross sectional view of a newly installed working lining prepared in accordance with the method of the present invention.

4). The granular composition 4 that has entered the gap 10 (see FIG. 4) may then be mechanically vibrated using the vibrating member 15 for a set time to compact the granular composition 4 to the proper density. With the granular composition 4 properly installed, the transporting and installing device 1 may be removed and then a heating member 14 may be positioned. The heating member 14 may also be indexed in a predetermined position (see FIG. 10). The heating member 14 then heat sets the granular composition 4 that is in gap 10 (FIG. 4). The heating member 14 may be programmed to automatically shut down and then removed after it has finished. Next, a cool down period takes place. After the cool down is complete, the mandrel member 7 and the transporting and installing device 1, if not earlier removed, may now be removed from the metallurgical vessel 9. When the mandrel member 7 and the transporting and installing device 1 have been removed, the metallurgical vessel 9, complete with the newly installed working lining 16 (see FIG. 9), is ready for use or for further preparation.

The storage member 12 (see FIG. 5) permits the storage of the granular composition 4 near the installation area in a controlled manner. This may be accomplished by, for example, loading large hoppers or silos by means of bulk delivery, which thus provides cost savings to the user. The advantage to this feature is having the granular composition 4 readily accessible to be supplied into the feeding member 13. This keeps the granular composition 4 in the same area at all times, which is in contrast to the way granular refractory composition has been inventoried conventionally. This permits the filling of the transporting and installing device 1 at the user's convenience, thus eliminating the common practice of breaking and loading 50 to 100 lb. bags of granular refractory material directly into the metallurgical vessel or a hopper, which usually requires more than one person's involvement. It is also possible to arrange the loading of the transporting and installing device 1 directly from large 2,000 to 4,000 lb. bags as is common in the industry.

Figure 10:
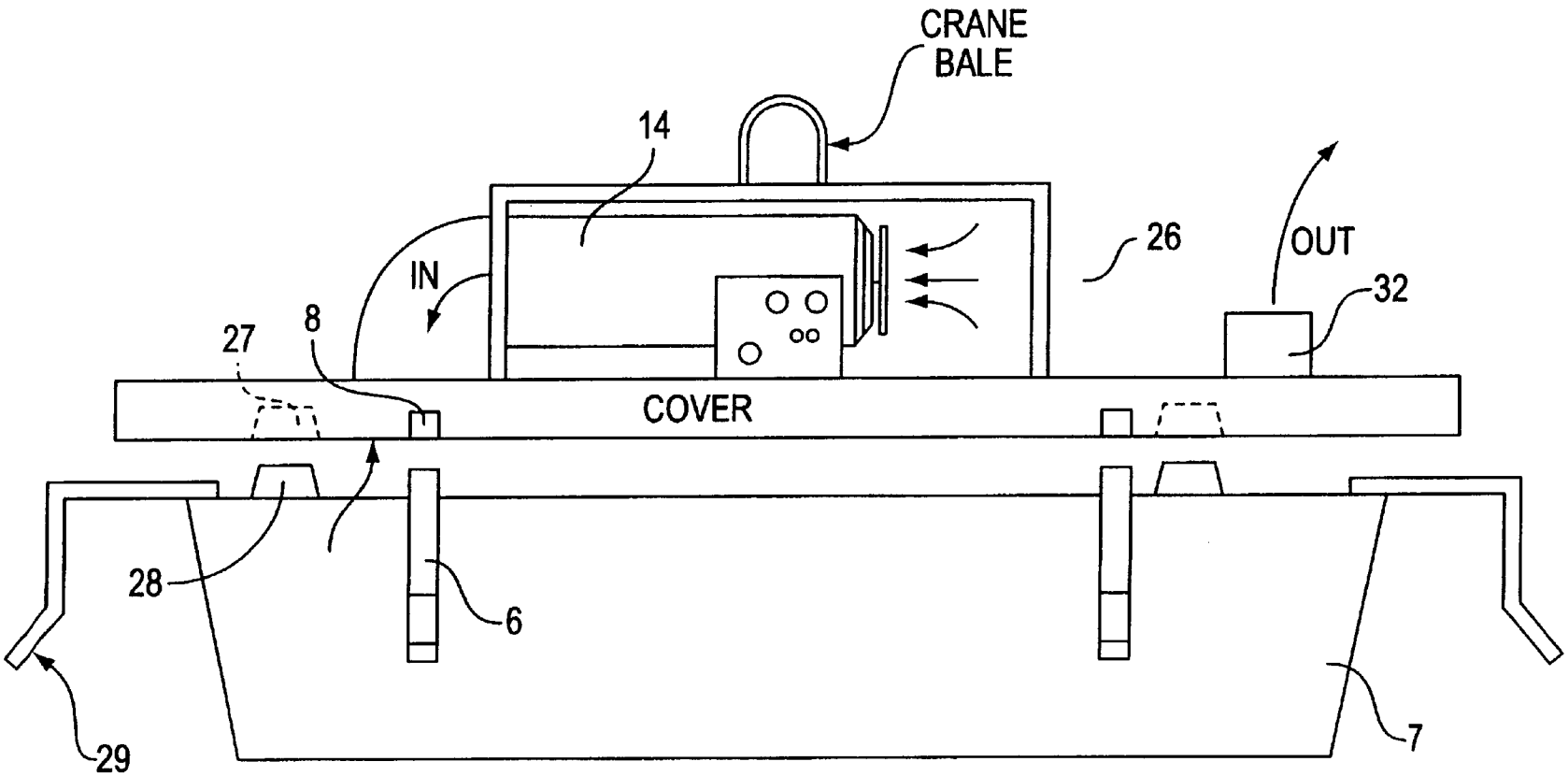
FIG. 10 is a schematic showing a heating member cover that mates with the mandrel member over the metallurgical vessel.

Turning to FIG. 10, FIG. 10 shows a heating member cover 26 that mates with the mandrel member 7. To center the heating member 14 over the metallurgical vessel (not shown), the heating member cover 26 can also be designed to mate with the transporting and installing device (not shown) of the invention. FIG. 10 shows guiding members 8 and 27, respectively, that mate the heating member cover 26 with complementary guiding members 6 and 28, respectively, on the mandrel member 7 to center the heating member 14 over the center of the mandrel member 7. The guiding members 27 and 28 are a variation, wherein a funnel (27)/cone (28) mating relationship is used. The heating member 14 heats mandrel member 7 through a first opening 31 in the heating member cover 26. The heat exits through a second opening 32 at the opposite end of the heating member cover 26 after travelling through the mandrel member 7. The mandrel member 7 in FIG. 10 also contains additional directing members 29 and 6, and the like, to further aid in the positioning of the mandrel member 7 over the metallurgical vessel (not shown).

Figure 11A:
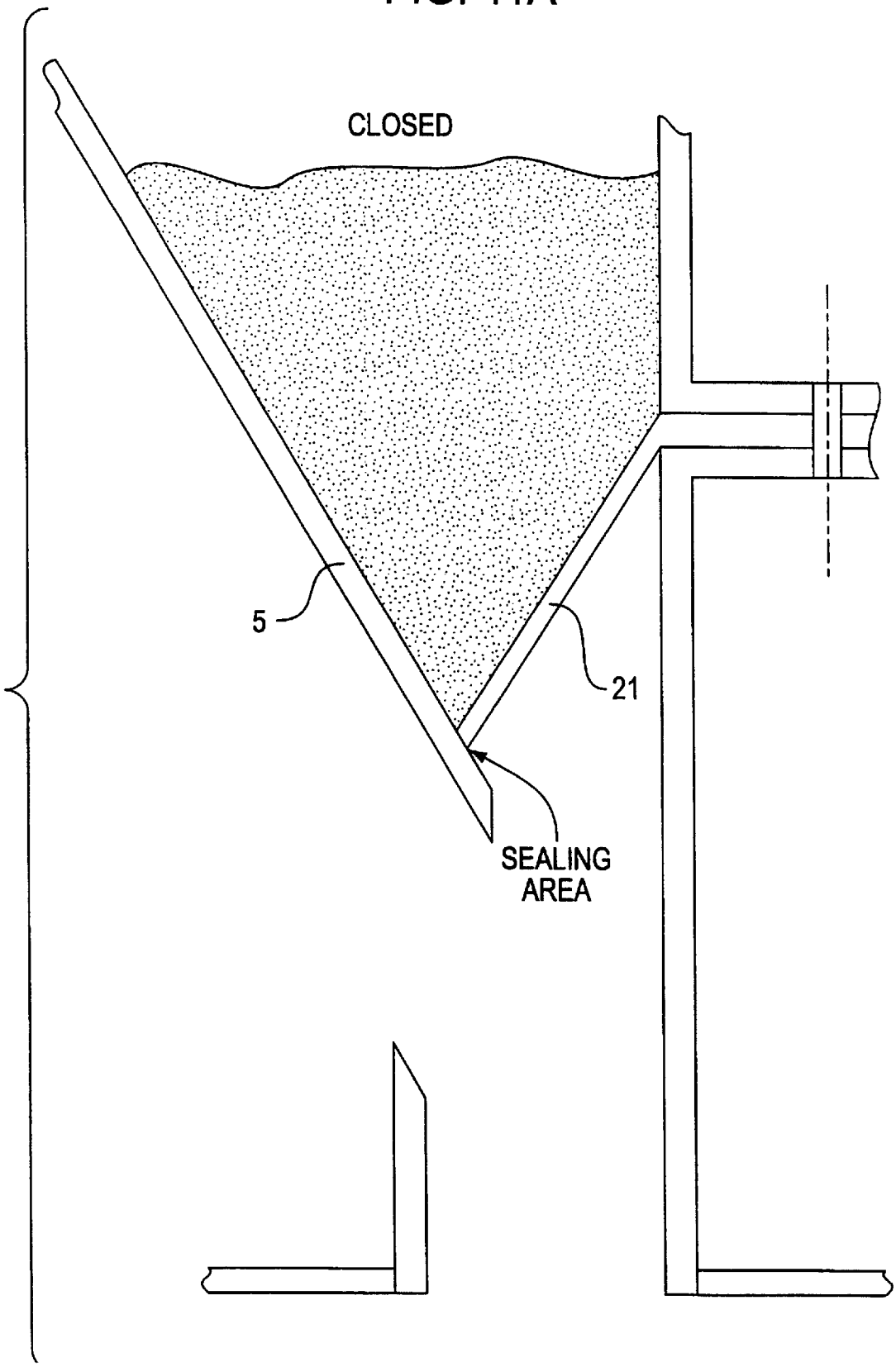
FIG. 11A and FIG. 11B are schematics showing an example of another type of a valve that can be used in the transporting and installing device of the invention in the closed (FIG. 11A) and the opened (FIG. 11B) positions.
Figure 11B:
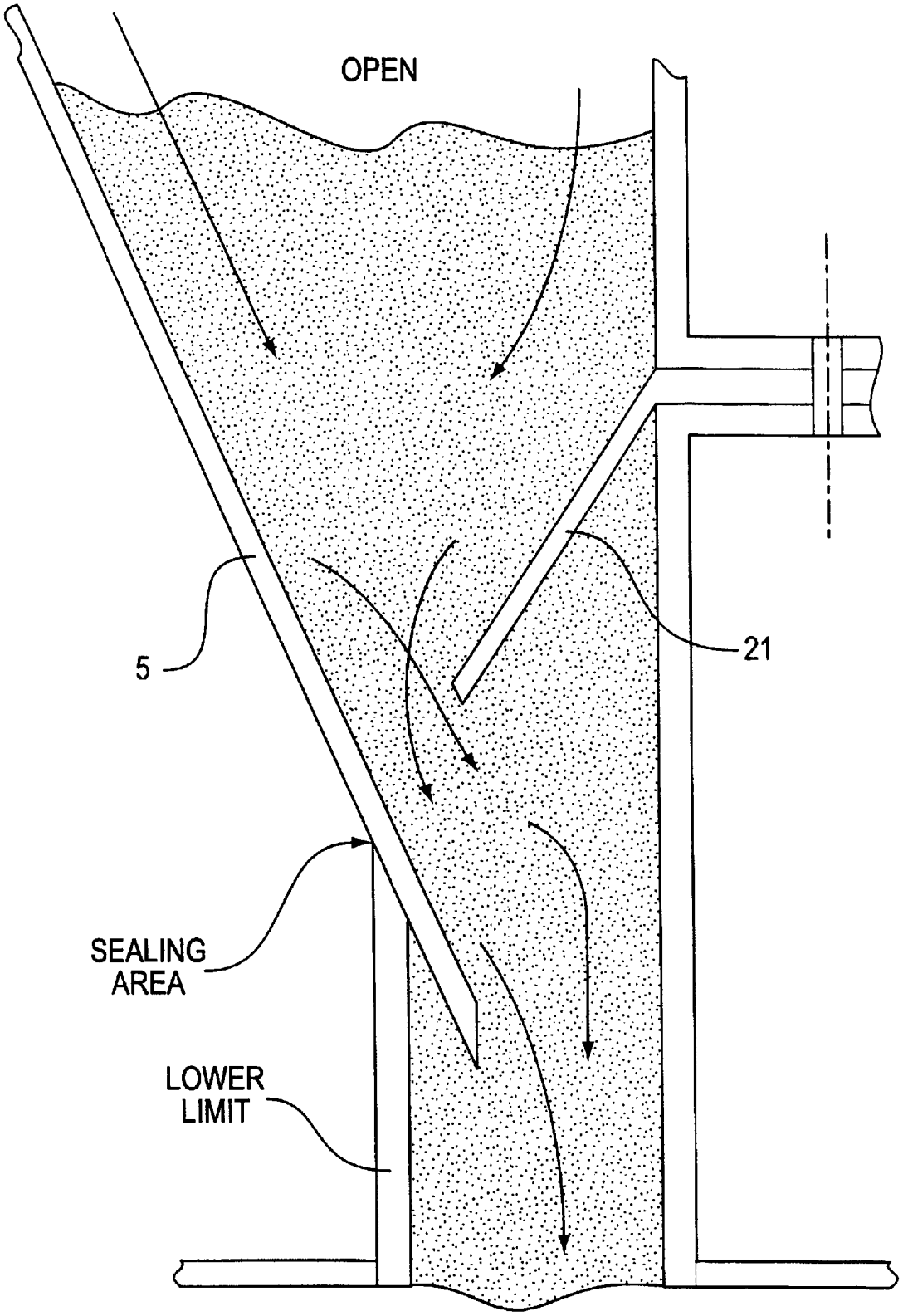
Figure 12:
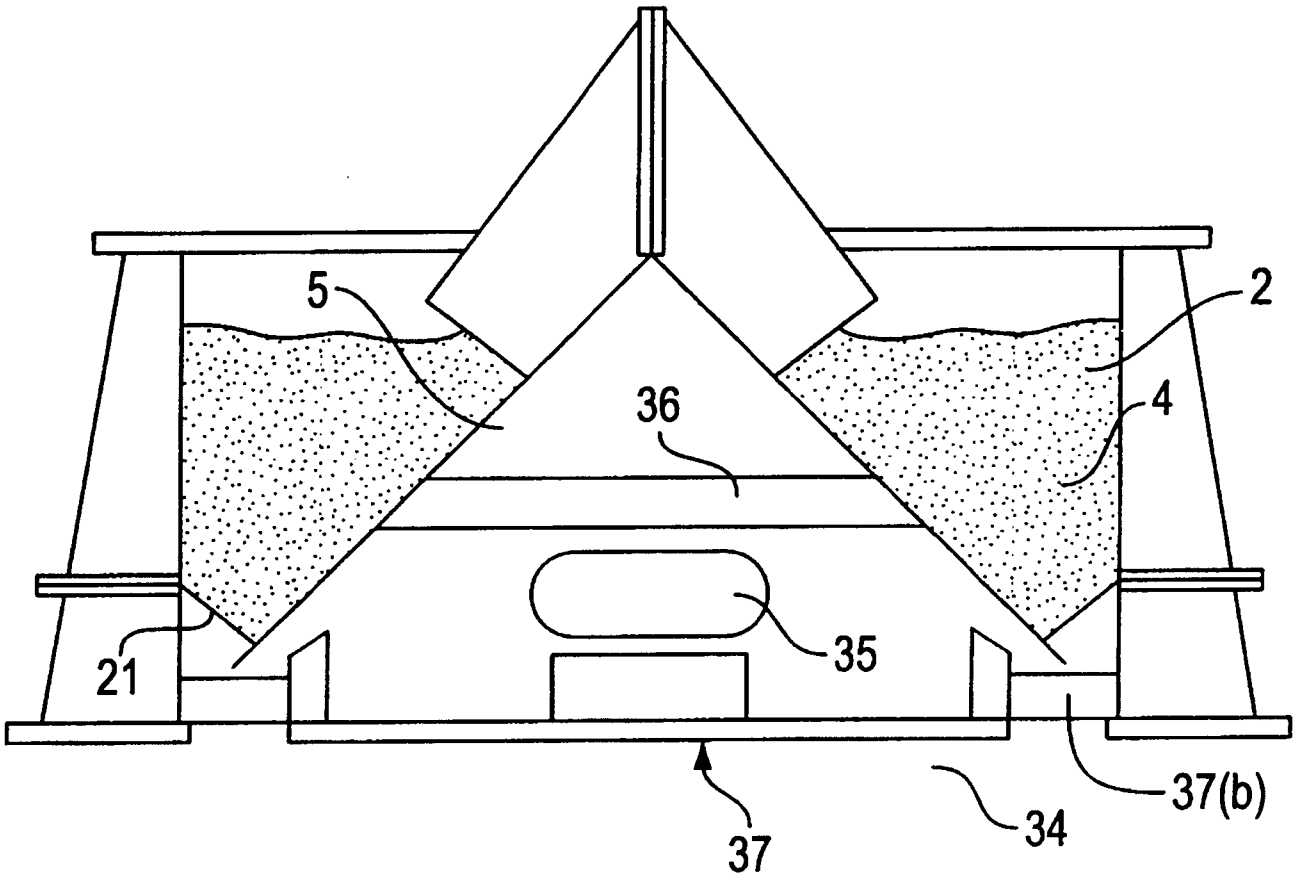
FIG. 12 is a schematic showing the use of an air bag as an actuator in a system to support and release the granular composition that can be used in the transporting and installing device of the invention.

Turning to FIG. 11A, FIG. 11B and FIG. 12, which are schematics showing an example of a valve system that can be used in the transporting and installing device (not shown) of the invention. FIG. 12 shows an air bag actuator system 34 that, when pressurized, maintains in conjunction with the deflectors 20, the valves 5 in the closed position. The air bag system 34 comprises an air bag 35 attached to support 36, which, in turn, abuts the valves 5 and a mandrel mating flange 37 of the transporting and installing device 1. When pressurized, the air bag 35 holds up the support 36, which in turn, holds up the valves 5, thus maintaining closure between the valves 5 and the deflectors 20 (see FIG. 11A). When pressure is released from the air bag 35, the valves 5 drop, and the granular composition 4 is released (see FIG. 11B). The valves 5 thus can be closed and opened by inflating and deflating the air bag 35, respectively.

Figure 13A:
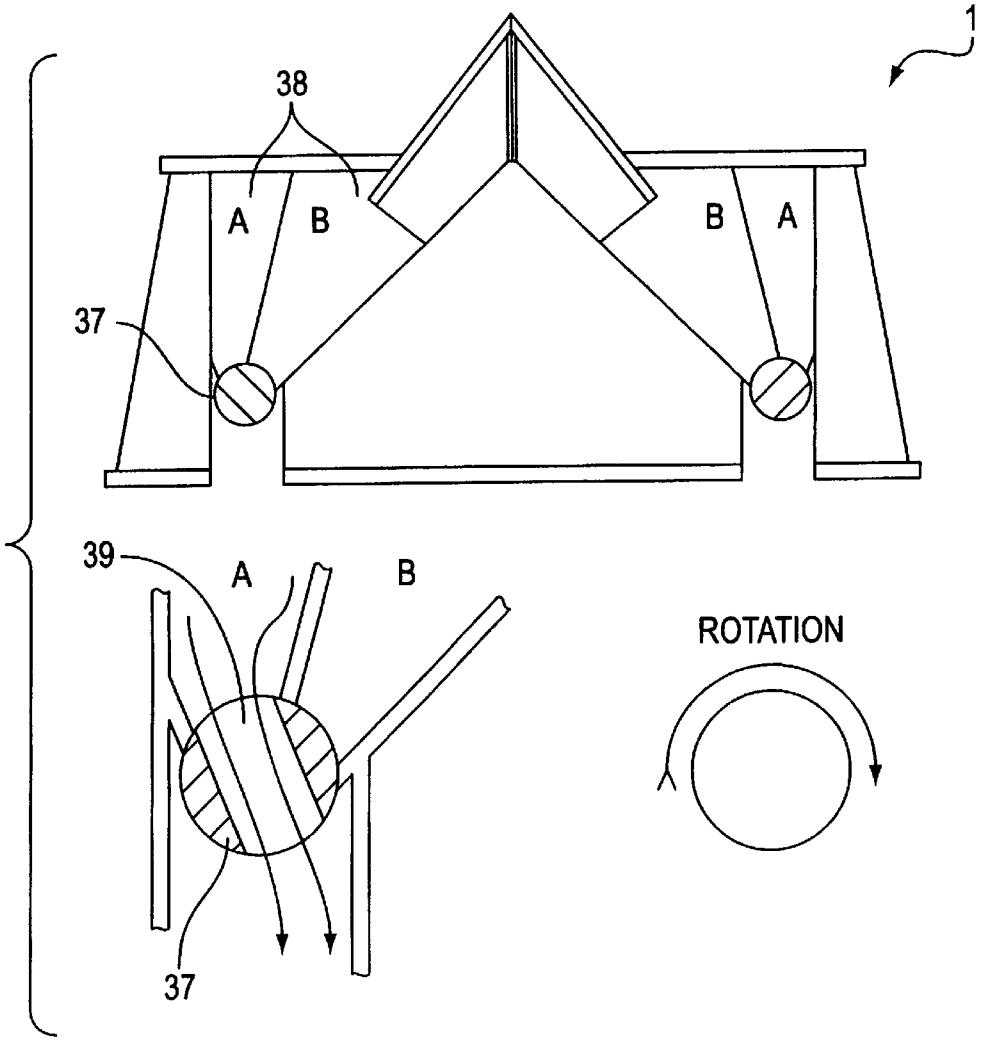
FIG. 13A and FIG. 13B are schematics showing a cross sectional view of a rotary valve system that may be used to install one or two or more different granular compositions that can be used in the transporting and installing device of the invention.
Figure 13B:
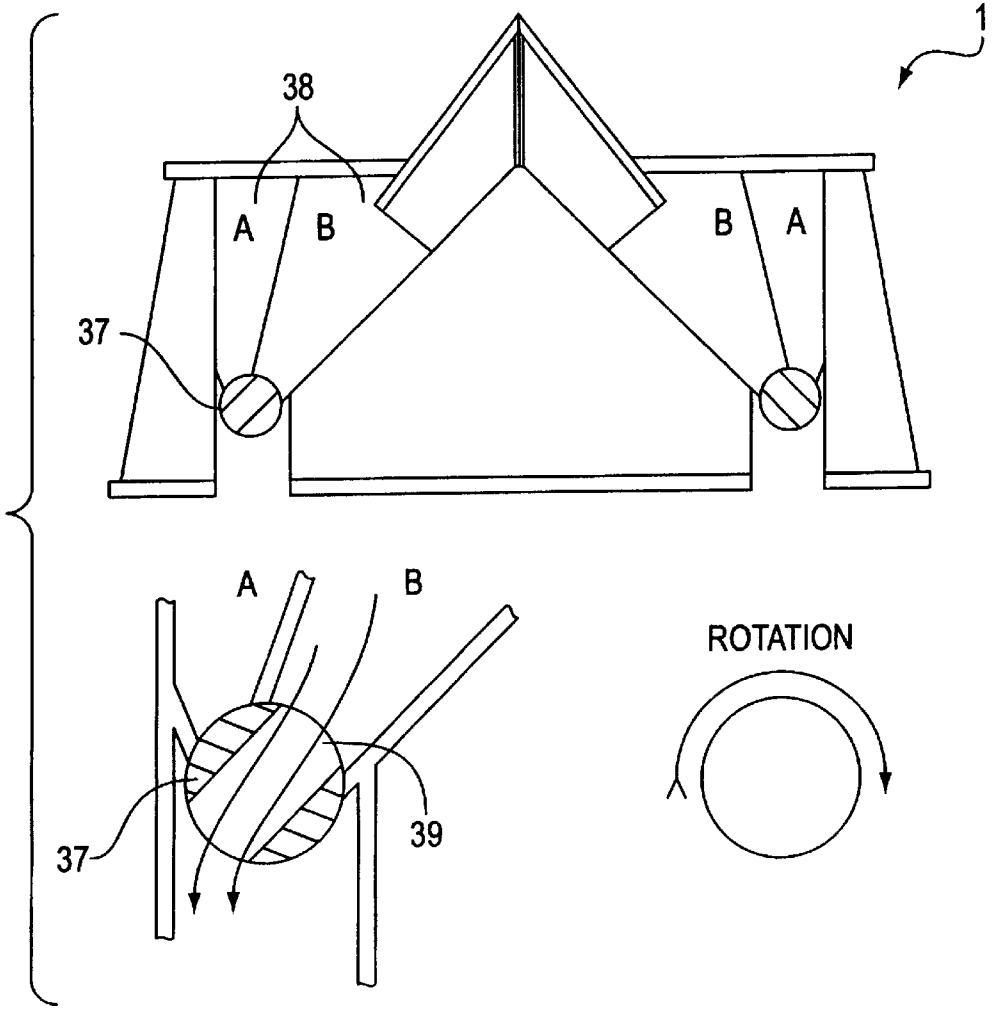

Turning to FIG. 13A and FIG. 13B, which are schematics showing a cross sectional view of a rotary valve 37 that may be used in the transporting and installing device 1 of the invention. The rotary valve 37 has a passageway 39 that may be aligned with one or more holding chambers 38*a* and 38*b* for holding one or more granular compositions (not shown). When the passageway 39 is lined up with one of the one or more holding chambers 38*a* and 38*b*, the granular composition contained within one of the one or more holding chambers 38*a* and 38*b* is released into the metallurgical vessel (not shown). Use of the rotary valve 37 permits the application of more than one type of granular composition (not shown) into the metallurgical vessel (not shown).

The present invention will be further illustrated in the following non-limiting Example and accompanying drawings.

EXAMPLE 560 pounds of granular material was dropped into a gap formed between a mandrel and a small Plexiglas scale model of a metallurgical vessel in a single mass to form a lining in accordance with the invention. The process took about 3–5 seconds. This is in contrast to the conventional method of breaking 50–100 lb. bags and filling the gap by hand, wherein only 20–30 lbs./min. may be installed, thus requiring at least 15–20 minutes to complete installation.

Figure 6A:
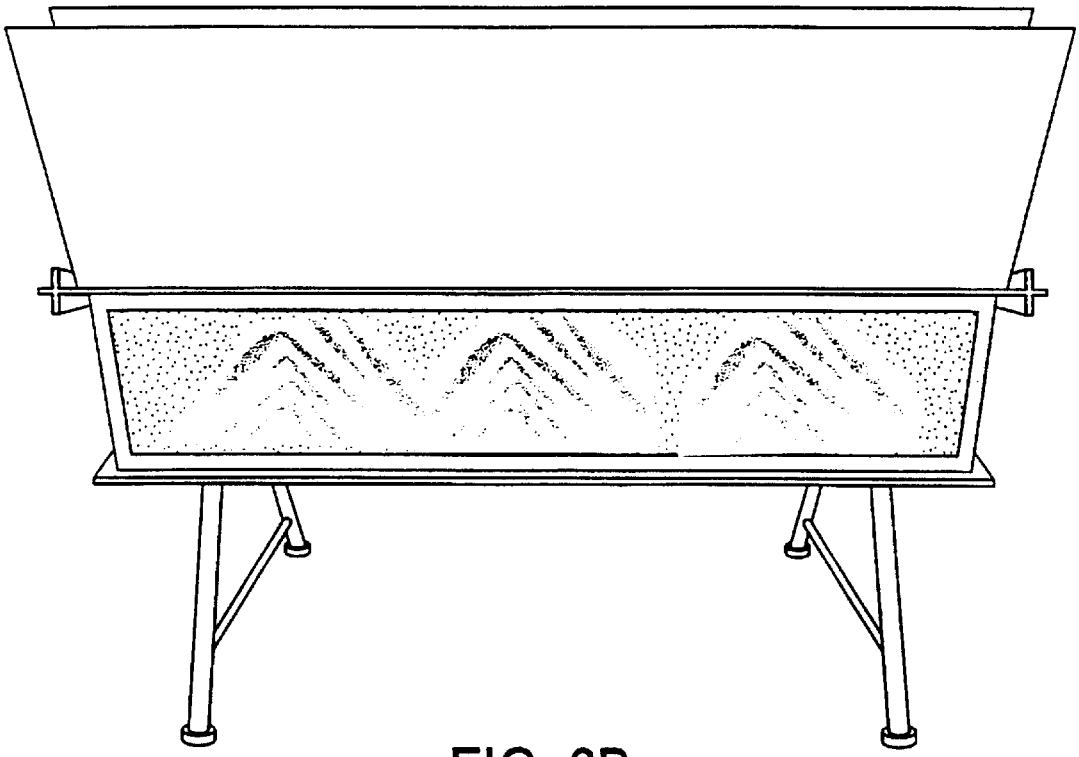
FIG. 6A and FIG. 6B are photographs of refractory lining installed using (1) a conventional method (FIG. 6A) and (2) the method of the present invention (FIG. 6B).
Figure 6B:
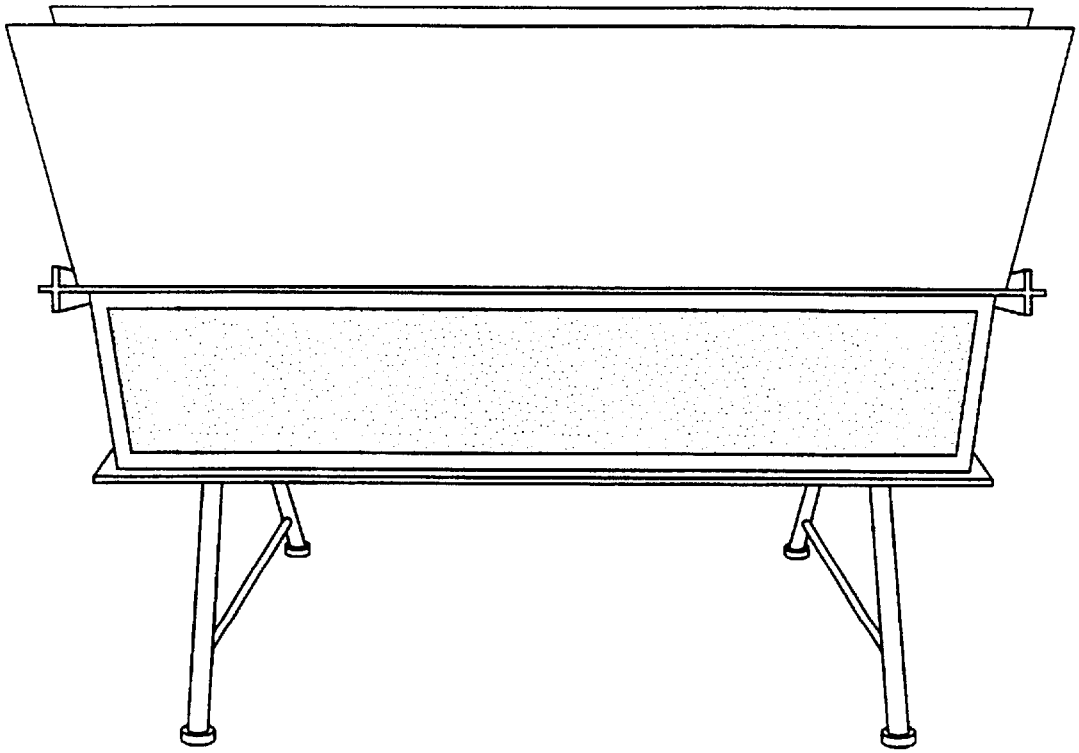
Figure 7A:
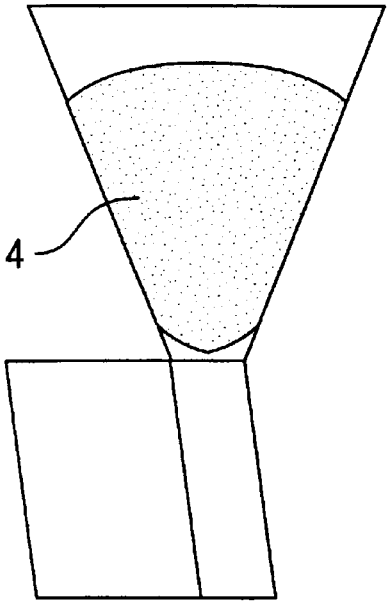
FIG. 7A, FIG. 7B, FIG. 7C and FIG. 7D are schematics that show why segregation of particle sizes is virtually non-existent in refractory linings installed using the method of the present invention.
Figure 7B:
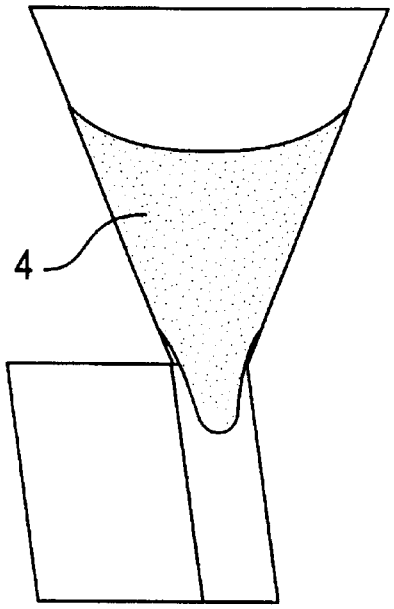
Figure 7D:
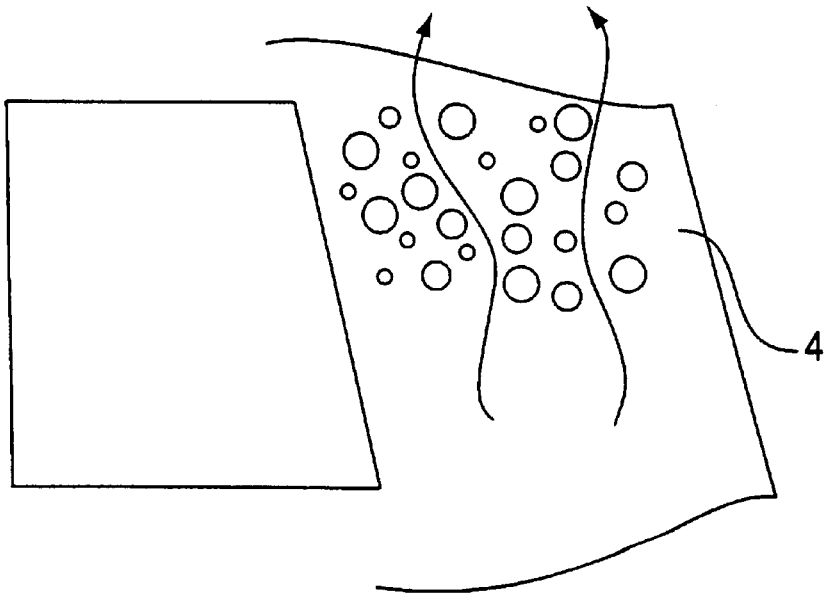
Figure 7C:
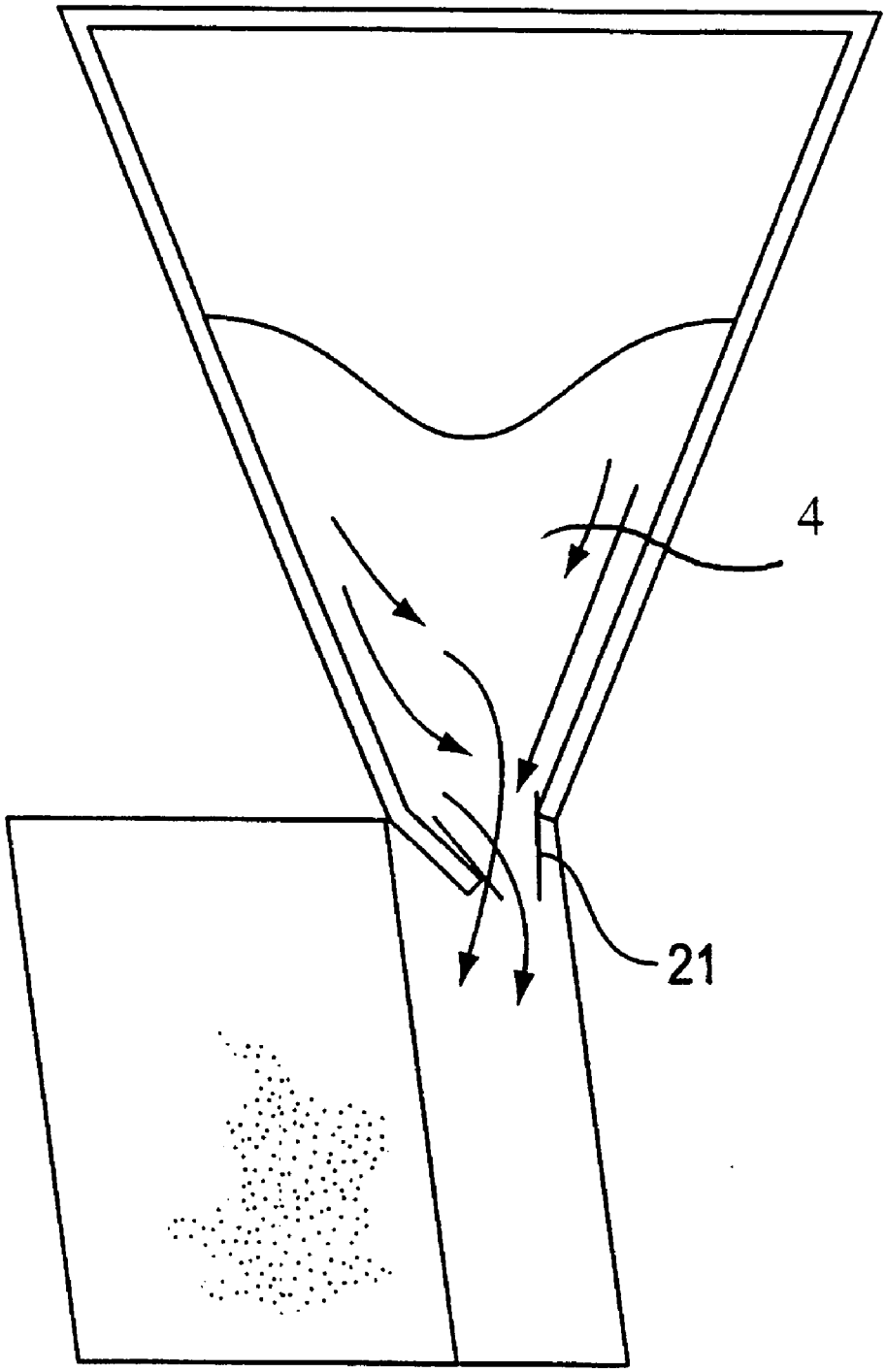

FIG. 6A and FIG. 6B are photographs of the small Plexiglas scale model showing refractory lining prepared using (1) a conventional method (FIG. 6A) and (2) the method of the present invention (FIG. 6B). As can be seen in FIG. 6A, the lining prepared using the conventional method, which results in segregation of the particle sizes, has coarse and fine layers. As discussed above, the varying layers in an installed lining are undesirable because of weak zones.

FIG. 7A, FIG. 7B, FIG. 7C and FIG. 7D are schematics that show why segregation of particles is virtually non-existent in refractory linings prepared using the method and apparatus of the present invention. As shown in FIGS. 7A to 7D, the granular refractory composition is installed into a gap formed between a mandrel and a metallurgical vessel in a single drop. When the material drops into the gap, the deflectors 21 direct and aid in the flow and premixing of the granular composition 4 (see FIG. 7C and FIG. 11B). In addition, any air that may be in the gap is displaced throughout the granular composition 4 (see FIG. 7D). The turbulence created by the drop creates a mixing action that tends to reduce any segregation of particle sizes that may have preexisted in the granular refractory composition in the transporting and installing device.

Figure 8A:
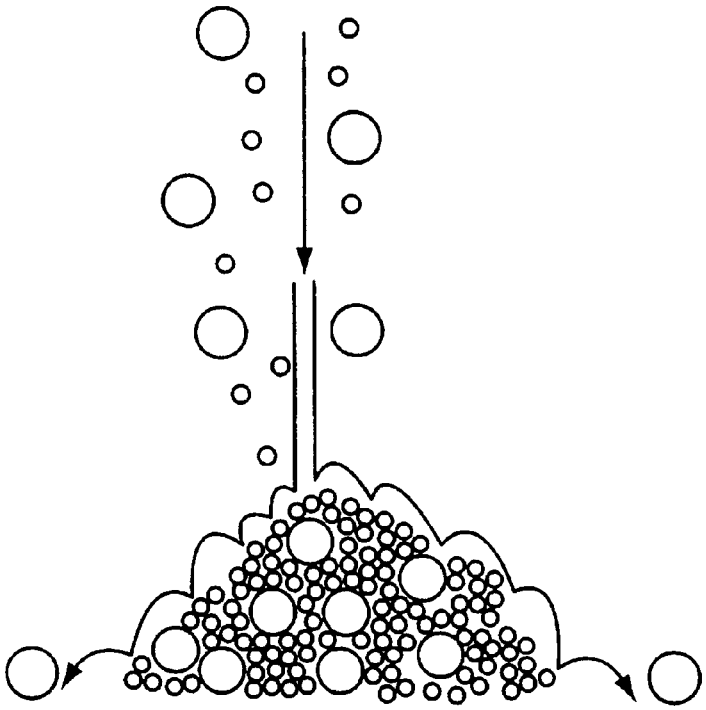
FIG. 8A and FIG. 8B are schematics showing how the segregation of particle sizes happen when refractory material is installed in a conventional manner.
Figure 8B:
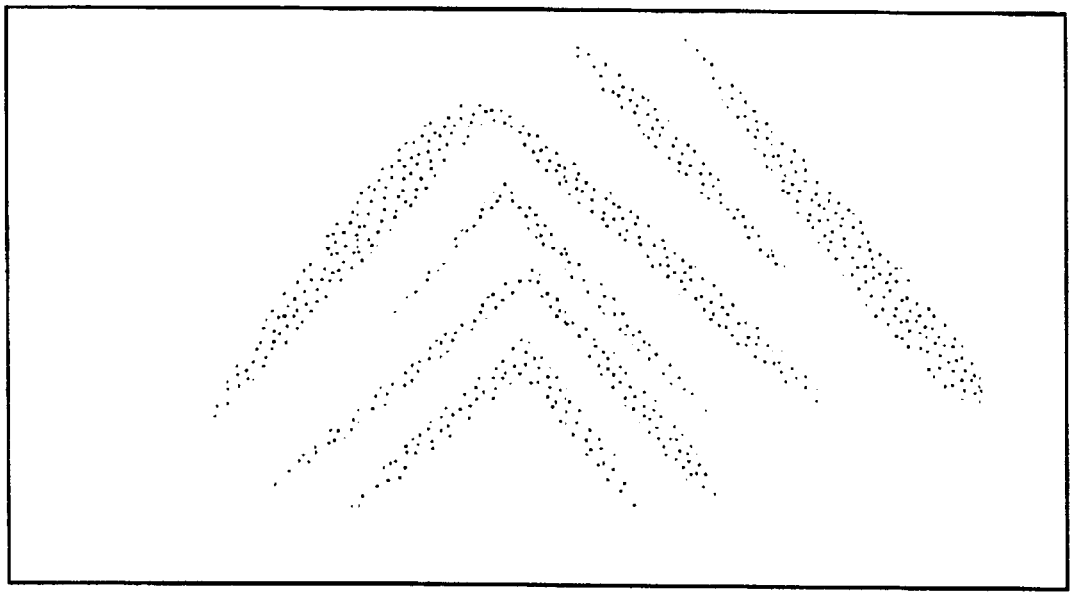

FIG. 8A and FIG. 8B are schematics showing segregation of particles by particle size when a granular refractory composition is installed using conventional methods. As can be seen in FIG. 8A and FIG. 5B, particles tend to segregate by particle size due to the differences in flow properties of large and small particles. As FIG. 5A shows, because large particles have more momentum than small particles, they tend to bounce and roll down a slope, wherein the small particles are more apt to pile up upon one another. FIG. 8B shows that the differences in flow properties of the large and small particles result in coarse and fine layers in the installed refractory lining.

Although the present invention has been fully described by way of examples with reference to the accompanying drawings, it is to be noted that various changes and modifications will be apparent to those skilled in the art. It is therefore intended that the foregoing detailed description be understood that it is the following claims, including all equivalents, which are intended to define the scope of this invention. Therefore, unless such changes and modifications depart from the scope of the present invention, they should be construed as being included therein.

What is claimed is:

1. A method for installing a substantially dry granular composition in the form of a single mass to form a layer on internal faces of a vessel comprising:

installing said granular composition into a gap formed between a mandrel and the internal faces of said vessel, said installing including allowing said granular composition to drop into said gap in the form of a single mass such that as the granular composition drops into said gap it is restrained only by said mandrel and the internal faces of said vessel.

2. The method of claim 1, wherein said granular composition is refractory material.

3. The method of claim 2, wherein said refractory material is dry vibratable material.

4. The method of claim 3, further comprising vibrating said dry vibratable material during said installing.

5. The method of claim 4, wherein said single mass forms a continuous refractory lining on internal faces of said vessel.

6. The method of claim 1, wherein said installing includes providing an amount of granular composition proportionate to a capacity of said gap.

7. The method of claim 1, wherein an installing member is used to install said granular composition, wherein said installing member comprises at least one valve, wherein said at least one valve corresponds to at least one holding area and to said gap formed between said mandrel and said vessel, wherein said at least one valve may be opened or closed, wherein when said at least one valve is opened, said granular composition is installed into said gap from said installing member.

8. The method of claim 7, wherein said at least one valve comprises an air bag actuator, a support and a valve member, wherein an air bag abuts said support and said support abuts said valve member, wherein when said air bag is inflated said at least one valve is in a closed position, and wherein when said air bag is deflated, said at least one valve is in an opened position.

9. The method of claim 7, wherein said transporting and installing device comprises one or more holding chambers, and wherein said at least one valve comprises a passageway that may be aligned with said one or more holding chambers.

10. The method of claim 1, wherein said installing is carried out more than one time to complete a vessel lining.

11. The method of claim 1, wherein said granular composition comprises particles of varying sizes and wherein said dropping of said granular composition in a single mass results in minimum segregation of larger particles from smaller particles.

12. The method of claim 1, wherein said vessel is a vessel for containing molten metal.

13. The method of claim 12, wherein said vessel is selected from the group consisting of tundish, ladle, electric arc furnace, induction furnace, degassing unit, and AOD (argon, oxygen, decarborization) vessel.

14. The method of claim 12, wherein said vessel is a non-ferrous liquid metal furnace selected from the group consisting of aluminum furnace and a copper furnace.

15. A method for installing a substantially dry granular composition in the form of a single mass to form a layer on internal faces of a vessel comprising:

installing said granular composition into a gap formed between a mandrel and the internal faces of said vessel, said installing including allowing said granular composition to drop into said gap in the form of a single mass and at a pressure not equal to atmospheric pressure and in a gas other than air.

16. The method of claim 15, wherein said granular composition is refractory material.

17. The method of claim 16, wherein said refractory material is dry vibratable material.

18. The method of claim 17, further comprising vibrating said dry virbratable material during said installing.

19. The method of claim 18, wherein said single mass forms refractory lining on internal faces of said vessel.

20. The method of claim 15, wherein said installing includes providing an amount of granular composition proportionate to a capacity of said gap.

21. The method of claim 15, wherein an installing member is used to install said granular composition, wherein said installing member comprises at least one holding area around its perimeter, wherein said holding area holds said granular composition.

22. The method of claim 15, wherein said vessel is selected from the group consisting of tundish, ladle, electric arc furnace, induction furnace, degassing unit, and AOD (argon, oxygen, decarborization) vessel.

23. The method of claim 15, wherein said vessel is a non-ferrous liquid metal furnace selected from the group consisting of an aluminum furnace, and a copper furnace.

24. A method for installing a substantially dry granular composition in the form of a single mass to form a layer on internal faces of a vessel comprising:

installing said granular composition into a gap formed between a mandrel and the internal faces of said vessel, said installing including allowing said granular composition to drop into said gap in the form of a single mass, and wherein an installing member comprising at least one valve is used to install said granular composition, wherein said installing member comprises at least one holding area around its perimeter, wherein said holding area holds said granular composition, and wherein said at least one valve corresponds to said at least one holding area and to said gap formed between said mandrel and said vessel, wherein said at least one valve may be opened or closed, and wherein when said at least one valve is opened, said granular composition is installed into said gap from said installing member.

25. The method of claim 24, wherein said granular composition is refractory material.

26. The method of claim 25, wherein said refractory material is dry vibratable material.

27. The method of claim 26, further comprising vibrating said dry vibratable material during said installing.

28. The method of claim 27, wherein said single mass forms a refractory lining on internal faces of said vessel.

29. The method of claim 24, wherein said installing includes providing an amount of granular composition proportionate to a capacity of said gap.

30. The method of claim 24, wherein said installing member comprises one or more deflectors, wherein said one or more deflectors aid flow and mixing of said granular composition.

31. The method of claim 24, wherein said method is carried out at a pressure not equal to atmospheric pressure and in a gas other than air.

32. The method of claim 24, wherein said installing is carried out more than one time to complete a vessel lining.

33. The method of claim 24, wherein said granular composition comprises particles of varying sizes and wherein said dropping of said granular composition in a single mass results in minimum segregation of larger particles from smaller particles.

34. The method of claim 24, wherein said vessel is selected from the group consisting of tundish, ladle, electric arc furnace, induction furnace, degassing unit, and (AOD) argon, oxygen, decarborization, vessel.

35. The method of claim 24, wherein said vessel is a non-ferrous liquid metal furnace selected from the group consisting of an aluminum furnace and a copper furnace.

36. The method of claim 24, wherein said at least one valve comprises an air bag actuator, a support and a valve member, wherein an air bag abuts said support and said support abuts said valve member, wherein when said air bag is inflated said at least one valve is in a closed position, and wherein when said air bag is deflated, said at least one valve is in an opened position.

37. The method of claim 24, wherein said transporting and installing device comprises one or more holding chambers, and wherein said at least one valve comprises a passageway that may be aligned with said one or more holding chambers.

38. A method for installing a substantially dry granular composition in the form of a single mass to form a layer on internal faces of a vessel comprising:

installing said granular composition into a gap formed between a mandrel and the internal faces of said vessel, said installing including allowing said granular composition to drop into said gap in the form of a single mass, wherein an installing member is used to install said granular composition, wherein said installing member comprises at least one holding area around its perimeter, wherein said holding area holds said granular composition, and wherein said installing member comprises one or more deflectors, wherein said one or more deflectors aid flow and mixing of said granular composition.

39. The method of claim 38, wherein said granular composition is refractory material.

40. The method of claim 39, wherein said refractory material is dry vibratable material.

41. The method of claim 40, further comprising vibrating said dry vibratable material during said installing.

42. The method of claim 41, wherein said single mass forms a refractory lining on internal faces of said vessel.

43. The method of claim 38, wherein said installing includes providing an amount of granular composition proportionate to a capacity of said gap.

44. The method of claim 38, wherein said method is carried out at a pressure not equal to atmospheric pressure and in a gas other than air.

45. The method of claim 38, wherein said installing is carried out more than one time to complete a vessel lining.

46. The method of claim 38, wherein said granular composition comprises particles of varying sizes and wherein said dropping of said granular composition in a single mass results in minimum segregation of larger particles from smaller particles.

47. The method of claim 38, wherein said vessel is selected from the group consisting of tundish, ladle, electric arc furnace, induction furnace, degassing unit, and AOD (argon, oxygen, decarborization) vessel.

48. The method of claim 38, wherein said vessel is a non-ferrous liquid metal furnace selected from the group consisting of an aluminum furnace and a copper furnace.

49. The method of claim 38, wherein said vessel is selected from the group consisting of tundish, ladle, electric arc furnace, induction furnace, degassing unit, and AOD (argon, oxygen, decarborization) vessel.

50. The method of claim 38, wherein said vessel is a non-ferrous liquid metal furnace selected from the group consisting of an aluminum furnace and a copper furnace.

* * * * *